US010930457B2

(12) United States Patent
Kato

(10) Patent No.: US 10,930,457 B2
(45) Date of Patent: Feb. 23, 2021

(54) ELECTROMAGNETIC RELAY DEICING SYSTEM INCLUDING CONTROL CIRCUIT

(71) Applicant: SUBARU CORPORATION, Tokyo (JP)

(72) Inventor: Daisuke Kato, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 81 days.

(21) Appl. No.: 16/436,596

(22) Filed: Jun. 10, 2019

(65) Prior Publication Data

US 2020/0098533 A1 Mar. 26, 2020

(30) Foreign Application Priority Data

Sep. 26, 2018 (JP) ..... JP2018-179617

(51) Int. Cl.
*H01H 47/02* (2006.01)
*H01H 50/12* (2006.01)
*H01R 13/629* (2006.01)

(52) U.S. Cl.
CPC ..... *H01H 47/02* (2013.01); *H01H 50/12* (2013.01); *H01H 2047/025* (2013.01); *H01R 13/629* (2013.01); *H01R 2201/26* (2013.01)

(58) Field of Classification Search
CPC .... H01H 7/02; H01H 50/12; H01H 2047/025; H01R 13/629; H01R 2201/26
See application file for complete search history.

(56) References Cited

U.S. PATENT DOCUMENTS 4,557,114 A * 12/1985 Kato ..... F24F 11/30 62/126
5,072,098 A * 12/1991 Matthews ..... H02J 7/1438 219/501
2014/0247099 A1* 9/2014 Carrete ..... H01H 50/12 335/156
2014/0302691 A1* 10/2014 Janfada ..... H01R 24/78 439/39

(Continued)

FOREIGN PATENT DOCUMENTS

JP 2017-084602 A 5/2017

*Primary Examiner* — Kyle J Moody
*Assistant Examiner* — Lakaisha Jackson
(74) *Attorney, Agent, or Firm* — McGinn IP Law Group, PLLC.

(57) ABSTRACT

An electromagnetic relay deicing system includes an electromagnetic relay that includes a common terminal, a normally open terminal, and a normally closed terminal and that supplies electric power from an electric power supplier to an electrical apparatus when the common terminal and the normally open terminal are connected, and a control circuit that controls an on-state and an off-state of the electromagnetic relay. During the on-state of the electromagnetic relay, the common terminal and the normally open terminal are connected by a movable piece. During the off-state of the electromagnetic relay, the common terminal and the normally closed terminal are connected by the movable piece. The control circuit deices the electromagnetic relay by causing, during the off-state of the electromagnetic relay, electric conduction between the common terminal and the normally closed terminal connected by the movable piece so that ice on a surface of the normally open terminal melts.

8 Claims, 5 Drawing Sheets

(56) References Cited

U.S. PATENT DOCUMENTS

| | | | | |
|---|---|---|---|---|
| 2014/0311436 | A1* | 10/2014 | Hirabayashi | H01H 51/065<br>123/179.25 |
| 2015/0115740 | A1* | 4/2015 | Miura | H01H 1/62<br>307/117 |
| 2018/0158633 | A1* | 6/2018 | Brandt | H01H 47/002 |
| 2018/0233311 | A1* | 8/2018 | Suzuki | H01H 47/02 |

* cited by examiner

ELECTROMAGNETIC RELAY DEICING SYSTEM INCLUDING CONTROL CIRCUIT

CROSS-REFERENCE TO RELATED APPLICATIONS

The present application claims priority from Japanese Patent Application No. 2018-179617 filed on Sep. 26, 2018, the entire contents of which are hereby incorporated by reference.

BACKGROUND

The disclosure relates to an electromagnetic relay deicing system and, more particularly, to a system for deicing an electromagnetic relay that controls, for example, supply of electric power to an electrical apparatus.

For example, vehicles, such as automobiles, use relatively large numbers of electromagnetic relays some of which are relays (two-contact relays) in which a movable piece is coupled to and decoupled from a terminal and the others of which are relays (three-contact relays) in which the coupling partner of a movable piece is switched back and forth between two terminals.

The electromagnetic relays support fundamental functions of vehicles, such as start of the motor and the traveling, turning and stopping of the vehicle, by, for example, supplying electric power and sending start signals to various electronic control units (ECUs), actuators, etc.

Therefore, when an electromagnetic relay becomes iced, one of such functions that is supported by the electromagnetic relay cannot be performed, so that a serious problem may occur.

In the case of vehicles equipped with internal combustion engines, icing of electromagnetic relays can be prevented or reduced by disposing the electromagnetic relays near the internal combustion engines. However, in electric vehicles and the like that are not equipped with internal combustion engines, the problem of icing of electromagnetic relays are likely to occur.

The icing of an electromagnetic relay occurs as water vapor evaporated in the electromagnetic relay in a warmed condition is sharply cooled in a low-temperature environment so that ice particles or ice films form on contacts provided within the electromagnetic relay.

When ice particles and the like are formed on surfaces of the contacts, the ice interferes so that the metal pieces cannot touch each other and therefore cannot conduct electricity, resulting in failure to perform operations such as supplying electric power and sending signals via the electromagnetic relay.

Therefore, for example, Japanese Unexamined Patent Application Publication No. 2017-84602 mentions that when an electromagnetic relay becomes iced, the electromagnetic relay is repeatedly turned on and off to move the movable piece back and forth within the electromagnetic relay so that ice particles and ice films adhering to surfaces of the contacts are broken and removed (hammered) and therefore electrical connection can be established.

SUMMARY

One aspect of the disclosure provides an electromagnetic relay deicing system. The system includes an electromagnetic relay and a control circuit. The electromagnetic relay includes a common terminal, a normally open terminal, and a normally closed terminal. The electromagnetic relay is configured to supply electric power from an electric power supplier to an electrical apparatus when the common terminal and the normally open terminal are connected. The control circuit is configured to control an on-state and an off-state of the electromagnetic relay. During the on-state of the electromagnetic relay, the common terminal and the normally open terminal are connected by a movable piece. During the off-state of the electromagnetic relay, the common terminal and the normally closed terminal are connected by the movable piece. The control circuit deices the electromagnetic relay by causing, during the off-state of the electromagnetic relay, electric conduction between the common terminal and the normally closed terminal connected by the movable piece so that ice on a surface of the normally open terminal melts.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
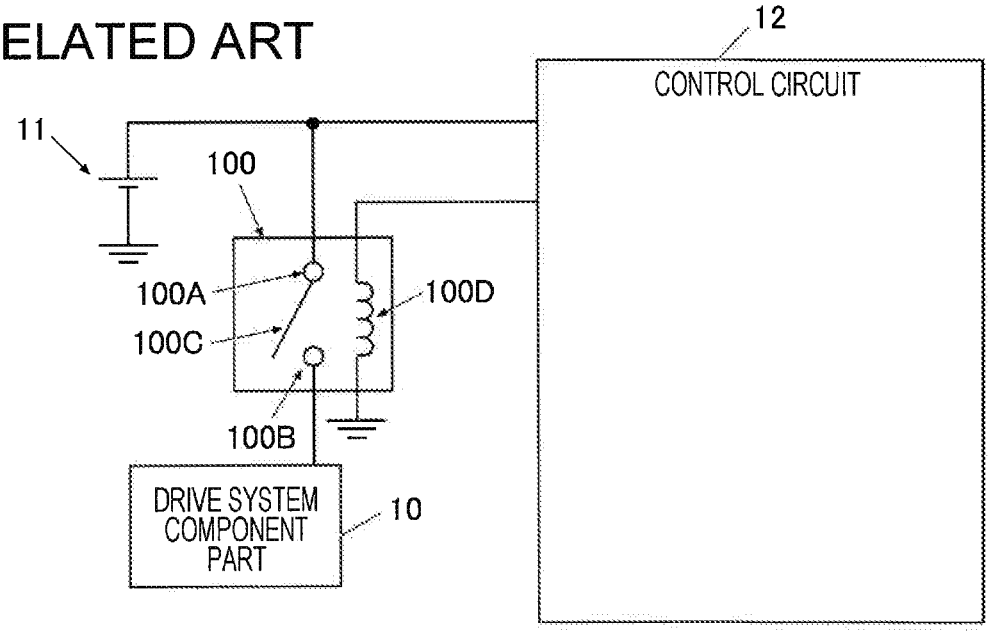
FIG. 1 RELATED ART
FIG. 1 is a diagram illustrating a control system for supplying electric power from an accessory battery to a drive system component part.

In the following, some embodiments of the disclosure are described in detail with reference to the accompanying drawings. Note that sizes, materials, specific values, and any other factors illustrated in respective embodiments are illustrative for easier understanding of the disclosure, and are not intended to limit the scope of the disclosure unless otherwise specifically stated. Further, elements in the following example embodiments which are not recited in a most-generic independent claim of the disclosure are optional and may be provided on an as-needed basis. Throughout the present specification and the drawings, elements having substantially the same function and configuration are denoted with the same reference numerals to avoid any redundant description. Further, elements that are not directly related to the disclosure are unillustrated in the drawings.

The drawings are schematic and are not intended to be drawn to scale. The icing of an electromagnetic relay can be effectively removed by hammering. Such hammering techniques for deicing electromagnetic relays are actually installed in vehicles.

However, hammering results in an increased number of on/off operations of an electromagnetic relay, giving rise to a possibility that a predetermined endurance number of operations of the electromagnetic relay will be reached. Therefore, it is often the case that a configuration is employed in which it is determined whether an electromagnetic relay is presently iced and, only when the electromagnetic relay is iced, the relay is subjected to hammering. Therefore, in the case where hammering is employed to remove the icing of an electromagnetic relay, it is usually necessary to newly provide a determination circuit for determining whether the electromagnetic relay is iced.

The icing of an electromagnetic relay occurs, for example, when the electromagnetic relay is suddenly cooled in a low-temperature environment after the electromagnetic relay is used, as mentioned above. Therefore, a configuration can be made such that, after an electromagnetic relay is used, the electromagnetic relay continues to be caused to conduct electricity and the current caused to flow through the electromagnetic relay is gradually reduced so that, after the electromagnetic relay is used, the temperature of the relay gradually decreases.

Such a configuration makes it possible to reduce the occurrence of icing of the electromagnetic relay. However, since current continues to be caused to flow through the electromagnetic relay even after the relay is used, energy loss occurs, which, in the case of an electric vehicle, leads to degraded electricity efficiency.

Actively warming an electromagnetic relay is also conceivable. However, a device for warming the electromagnetic relay is also used in this case and, furthermore, involves energy loss for warming the electromagnetic relay, which, in the case of an electric vehicle, leads to degraded electricity efficiency, as mentioned above.

Incidentally, some electromagnetic relays are sealed with an inert gas so as to be less likely to be iced; however, such electromagnetic relays are expensive and lead to increased costs.

It is desirable to provide an electromagnetic relay deicing system capable of precisely deicing an electromagnetic relay while reducing energy loss, without increasing the number of on/off operations of the electromagnetic relay and without a need to newly provide a large-scale apparatus or circuit.

An electromagnetic relay deicing system 1 according to the disclosure is configured so that, for example, when an electric vehicle starts its motor, an electromagnetic relay is not immediately turned on but, while the electromagnetic relay is off, electric conduction is caused between a common contact and a normally closed terminal (referred to also as an NC terminal) that are connected by a movable piece to heat the movable piece and the like so that ice on surfaces of a normally open terminal (referred to also as an NO terminal) melts and thus the electromagnetic relay is deiced.

The electromagnetic relay deicing system 1 according to the disclosure will be concretely described hereinafter with reference to some examples.

Although in the embodiments described below, electromagnetic relay deicing systems according to the disclosure are provided in electric vehicles, the use of the electromagnetic relay deicing system according to the disclosure is not limited to electric vehicles. Furthermore, the following description will be made in conjunction with cases where electrical apparatuses equipped with electromagnetic relay deicing systems according to the disclosure are drive system component parts (inverters and the like) and electric motors and electric power suppliers are accessory batteries and the like. However, these indicated cases do not restrict the scope of the electromagnetic relay deicing system according to the disclosure.

First Embodiment

For example, in some electric vehicles, as illustrated in FIG. 1, a drive system component part 10, such as an inverter, is connected to an accessory battery 11 via an electromagnetic relay 100 so that, at the time of starting the electric vehicle, the drive system component part 10 is activated by supplying the drive system component part 10 with electric power from the accessory battery 11 via the electromagnetic relay 100.

After the drive system component part 10 is activated, the electric power supplier that supplies electric power to the drive system component part 10 is switched from the accessory battery 11 to a main battery or the like (not illustrated in the drawings).

As illustrated in FIG. 1, the electromagnetic relay 100 is made up of a common terminal (COM terminal) 100A, a normally open terminal 100B, a movable piece 100C, an exciting coil 100D, etc.

The common terminal 100*a* is connected to the accessory battery 11 and the normally open terminal 100B is connected to the drive system component part 10.

Furthermore, the exciting coil 100D of the electromagnetic relay 100 is connected to a control circuit (electronic control unit (ECU)) 12.

The control circuit 12 causes current to flow through the exciting coil 100D and therefore excites the exciting coil 100D in order to couple the movable piece 100C to the normally open terminal 100B, that is, connect the common terminal 100A and the normally open terminal 100B of the electromagnetic relay 100, so that the accessory battery 11 supplies electric power to the drive system component part 10.

Furthermore, the control circuit 12 stops the supply of current to the exciting coil 100D and therefore stops the excitation of the exiting coil 100D in order to separate the movable piece 100C from the normally open terminal 100B, that is, disconnect the common terminal 100A from the normally open terminal 100B of the electromagnetic relay 100, so that the supply of electric power from the accessory battery 11 to the drive system component part 10 stops.

Thus, the control circuit 12 is configured to switch between supply of electric power from the electric power supplier (the accessory battery 11, the main battery, etc.) to the drive system component part 10 and stop of the supply of electric power by switching between supply of current to the exciting coil 100D and stop of the supply of current thereto.

The state in which the exciting coil of the electromagnetic relay is excited is referred to as the on-state of the electromagnetic relay and the state in which the exciting coil of the electromagnetic relay is not excited is referred to as the off-state of the electromagnetic relay.

Figure 2:
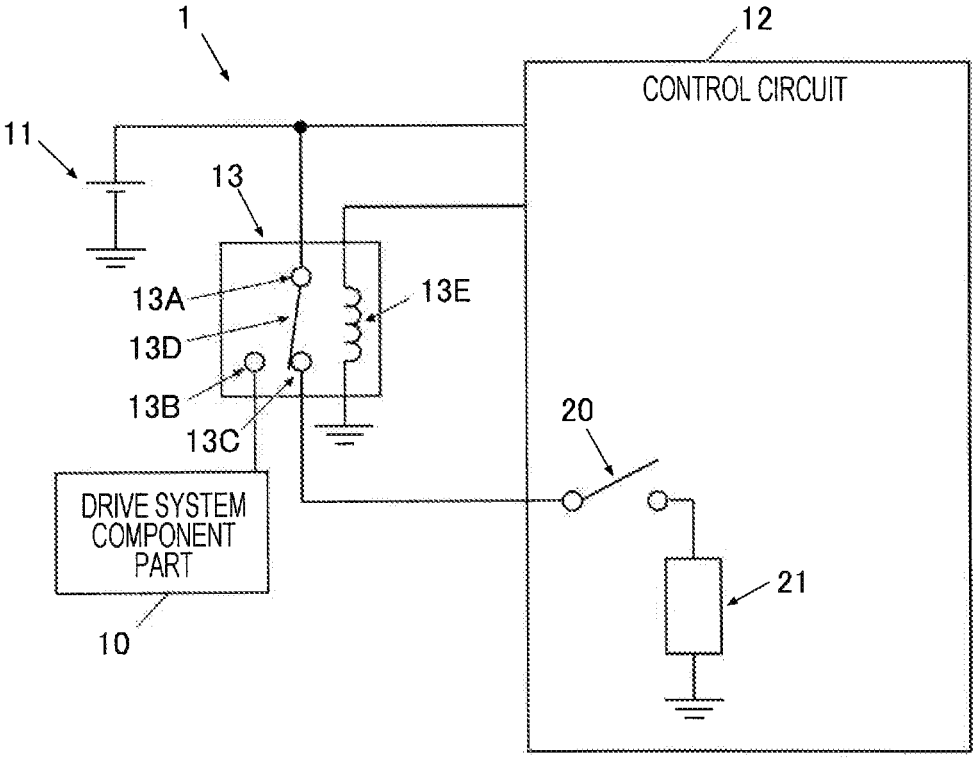
FIG. 2 is a diagram illustrating a configuration of an electromagnetic relay deicing system according to a first embodiment of the disclosure.

FIG. 2 illustrates a configuration of the electromagnetic relay deicing system 1 according to the embodiment.

In this embodiment, an electromagnetic relay 13 is not a two-contact relay in a related art as illustrated in FIG. 1 but is a three-contact relay as illustrated in FIG. 2.

It is usually the case that a two-contact relay and a three-contact relay have identical external shapes and therefore a three-contact relay can be fitted into a related-art acceptor opening for a two-contact relay without a need to alter the acceptor opening.

Concretely, in this embodiment, the electromagnetic relay 13 includes a common terminal 13A, a normally open terminal 13B, a normally closed terminal 13C, a movable piece 13D, and an exciting coil 13E.

The exciting coil 13E of the electromagnetic relay 13 is connected to a control circuit 12.

By exciting or stopping exciting the exciting coil 13E, the control circuit 12 controls the on and off-states of the electromagnetic relay 13 and switches the coupling partner of the movable piece 13D between the normally open terminal 13B and the normally closed terminal 13C.

Specifically, when the control circuit 12 supplies current to the exciting coil 13E of the electromagnetic relay 13 to excite the exciting coil 13E, the coupling partner of the movable piece 13D is switched from the normally closed terminal 13C to the normally open terminal 13B.

Therefore, during the on-state of the electromagnetic relay 13 (the state in which the exciting coil 13E is excited), the movable piece 13D connects the common terminal 13A and the normally open terminal 13B.

When the control circuit 12 stops the supply of current to the exciting coil 13E of the electromagnetic relay 13 and therefore stops the excitation of the exciting coil 13E, the coupling partner of the movable piece 13D of the electromagnetic relay 13 is switched from the normally open terminal 13B to the normally closed terminal 13C.

Therefore, during the off-state of the electromagnetic relay 13 (the state in which the exciting coil 13E is not excited), the movable piece 13D connects the common terminal 13A and the normally closed terminal 13C.

Therefore, in this embodiment, the control circuit 12 controls the turning on/off of the electromagnetic relay 13 and switches the coupling partner of the movable piece 13D of the electromagnetic relay 13 between the normally open terminal 13B and the normally closed terminal 13C by switching between excitation of the exciting coil 13E of the electromagnetic relay 13 and stop of excitation of the exciting coil 13E.

Furthermore, in this embodiment, as illustrated in FIG. 2, the common terminal 13A of the electromagnetic relay 13 is connected to the accessory battery 11 and the normally open terminal 13B is connected to the drive system component part 10.

Therefore, when the control circuit 12 turns on the electromagnetic relay 13 so that the movable piece 13D connects the common terminal 13A and the normally open terminal 13B, electric power is supplied to the drive system component part 10 from the electric power supplier (the accessory battery 11, the main battery, etc.) via the electromagnetic relay 13. Therefore, when the electromagnetic relay 13 is turned on at the time of starting the electric vehicle, electric power is supplied from the accessory battery 11 to the drive system component part 10 so that the drive system component part 10 activates.

Furthermore, when the control circuit 12 turns off the electromagnetic relay 13, the coupling partner of the movable piece 13D switches from the normally open terminal 13B to the normally closed terminal 13C and therefore the electromagnetic relay 13 cuts off the supply of electric power from the electric power supplier (the accessory battery 11, the main battery, etc.) to the drive system component part 10. Hence, the supply of electric power to the drive system component part 10 stops.

In this embodiment, the control circuit 12 controls the turning on/off of the electromagnetic relay 13 in the manner described above so as to control supply and stop of supply of electric power to the drive system component part 10 from the electric power supplier (the accessory battery 11, the main battery, etc.).

Next, a configuration for deicing the electromagnetic relay 13 in the electromagnetic relay deicing system 1 according to this embodiment and the like will be described.

As illustrated in FIG. 2, in this embodiment, the normally closed terminal 13C of the electromagnetic relay 13 is connected to an electric resistor 21 via a switch 20. The switch 20 is opened and closed by the control circuit 12.

Although in FIG. 2, the switch 20 and the electric resistor 21 are provided within the control circuit 12, the switch 20 and the electric resistor 21 can be provided outside the control circuit 12.

As described above, when the electromagnetic relay 13 is off, the movable piece 13D connects the common terminal 13A and the normally closed terminal 13C (the state illustrated in FIG. 2).

In this embodiment, the control circuit 12 closes the switch 20 during this state (i.e., when the electromagnetic relay 13 is off) so that electricity is conducted between the normally closed terminal 13C and the common terminal 13A connected by the movable piece 13D.

Then, current form the accessory battery 11 flows through the electromagnetic relay 13, the switch 20, the electric resistor 21, etc., so that heat is produced from the movable piece 13D of the electromagnetic relay and the like as well as the electric resistor 21. Therefore, the normally closed terminal 13B, which is adjacent to the movable piece 13D, is also heated so that ice on the surface of the normally open terminal 13B melts.

In this embodiment, the electromagnetic relay 13 is deiced in this manner.

Functions of the electromagnetic relay deicing system 1 according to this embodiment will be described in conjunction with the time of starting the electric vehicle as an example.

It is to be noted that immediately before the electric vehicle is started, the electromagnetic relay 13 is off and the coupling partner of the movable piece 13D is the normally closed terminal 13C. It is assumed that at this time point, ice is present on the surface of the normally open terminal 13B of the electromagnetic relay 13 and therefore the electromagnetic relay 13 is iced.

When the electric vehicle is started by a driver's starting operation, the control circuit 12 closes the switch 20 while maintaining the off-state of the electromagnetic relay 13. Then, current flows from the accessory battery 11 through the electromagnetic relay 13, the switch 20, the electric resistor 21, etc., so that the electric resistor 21 and the movable piece 13D of the electromagnetic relay 13, and the like, produce heat.

Therefore, the normally open terminal 13B, which is adjacent to the movable piece 13D or the like, is heated so that the ice on the surface of the normally closed terminal 13B melts. Thus, the electromagnetic relay 13 is deiced.

In this manner, the electromagnetic relay deicing system 1 according to this embodiment certainly deices the electromagnetic relay 13 in the above-described manner.

Then, after a predetermined time elapses following the start of the electric vehicle, the control circuit 12 excites the exciting coil 13E of the electromagnetic relay 13 to turn on the electromagnetic relay 13. Then, because the ice on the surface of the normally open terminal 13B of the electromagnetic relay 13 has melted, the movable piece 13D is caused to switch the coupling partner certainly to the normally open terminal 13B.

Therefore, electric power is certainly supplied from the accessory battery 11 to the drive system component part 10 via the electromagnetic relay 13, so that the drive system component part 10 is activated.

In the electromagnetic relay deicing system 1 according to this embodiment, as described above, the control circuit 12 closes the switch 20 to energize the electromagnetic relay 13, the electric resistor 21, etc. during the off-state of the electromagnetic relay 13 so that the movable piece 13D of the electromagnetic relay 13 and the like produce heat to melt ice on the surface of the normally open terminal 13B of the electromagnetic relay 13 melts. Thus, the electromagnetic relay 13 is deiced.

Therefore, this embodiment deices the electromagnetic relay 13 during the off-state of the electromagnetic relay 13, and therefore hammering is not performed, unlike the foregoing related art. This makes it possible to deice the electromagnetic relay 13 without increasing the number of times that the electromagnetic relay 13 is turned on and off.

When the switch 20 is closed, a voltage from the accessory battery 11 (e.g., 12 V) is applied across the electric resistor 21. If the resistance value of the resistor 21 is set to a small value beforehand, a large current flows through the electric resistor 21.

Therefore, the temperatures of the movable piece 13D and the like sharply increase and, therefore, the normally open terminal 13B, which is adjacent to the movable piece 13D and the like, is rapidly heated, melting ice on the surface of the normally open terminal 13B. Thus, the deicing of the electromagnetic relay 13 is very quickly completed.

Therefore, in this embodiment, the amount of time for which the control circuit 12 energizes the electromagnetic relay 13, the electric resistor 21, etc. by closing switch 20 during the off-state of the electromagnetic relay 13 is pre-set to a very short time. That is, the time from closure of the switch 20 to opening of the switch 20 is set very short.

Thus, in the electromagnetic relay deicing system 1 according to this embodiment, the current that flows through the electromagnetic relay 13 is large but continues only for a very short time, so that it becomes possible to precisely reduce the energy loss, that is, the amount of energy of the accessory battery 11 that is consumed in order to deice the electromagnetic relay 13.

Furthermore, the electromagnetic relay deicing system 1 according to this embodiment can be configured merely by replacing the two-contact relay 100 in the related-art control system (see FIG. 1) with the three-contact relay 13 (see FIG. 2) and providing the switch 20 and the electric resistor 21.

Therefore, precise deicing of the electromagnetic relay 13 is made possible merely by making a simple alteration to a related-art control system without a need to newly provide a large-scale apparatus or circuit.

It is to be noted that in this embodiment, since the electromagnetic relay 13 is deiced in a very short time, the aforementioned predetermined time of operation of the control circuit 12 can be set to a very short time and, more specifically, the control circuit 12 can turn on the electromagnetic relay 13 in a very short time following the starting of the electric vehicle so as to supply electric power from the accessory battery 11 to the drive system component part 10.

This leads to another advantage. That is, when the electric vehicle is started by an occupant's starting operation, the electromagnetic relay 13 turns on and therefore the drive system component part 10 activates at a time that is substantially the same time as in a related art, so that the occupant can start the electric vehicle without feeling a sense of strangeness and without realizing that the electromagnetic relay 13 was iced and an operation of deicing the electromagnetic relay 13 has been performed.

Second Embodiment

In some related-art technologies, a control circuit is provided with wiring or the like for redundancy (for backup).

Figure 3:
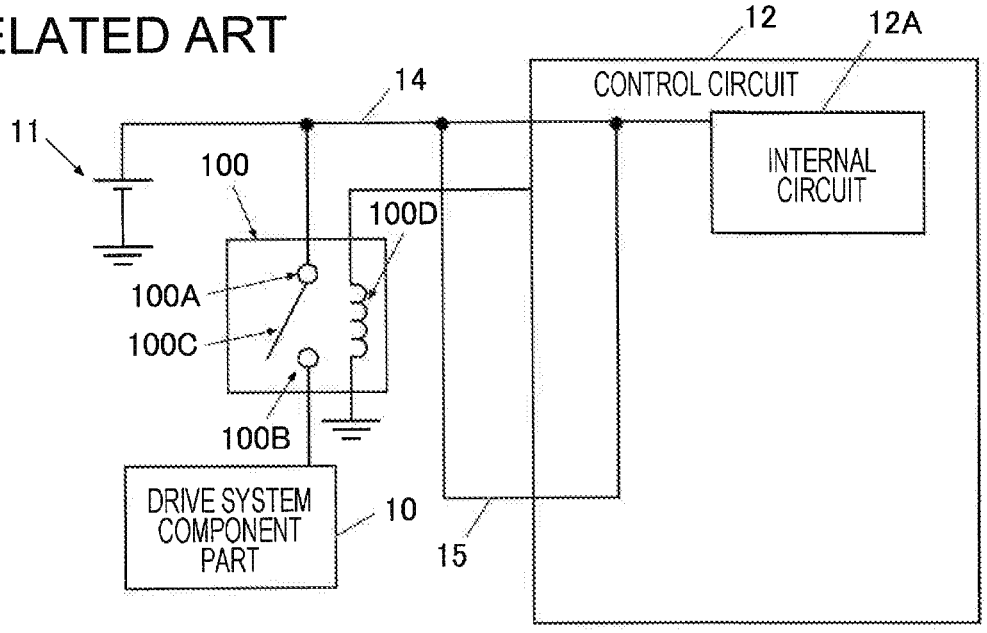
FIG. 3 RELATED ART
FIG. 3 is a diagram illustrating a control system in which a control circuit is provided with a redundancy wire.

For example, in a control system as illustrated in FIG. 1, a main wire 14 connecting the accessory battery 11, the main battery (not illustrated), etc. to the internal circuit 12A of the control circuit 12 is sometimes provided with a redundancy wire 15 for the purpose of redundancy as illustrated in FIG. 3.

Therefore, by using the redundancy wire 15, an electromagnetic relay deicing system 2 can be configured. This will be concretely described below.

In the following description, substantially the same members and the like as those in the first embodiment will be represented by the same reference characters as those used in the first embodiment. Furthermore, description of the same members and the like as those in the first embodiment may be omitted.

Figure 4:
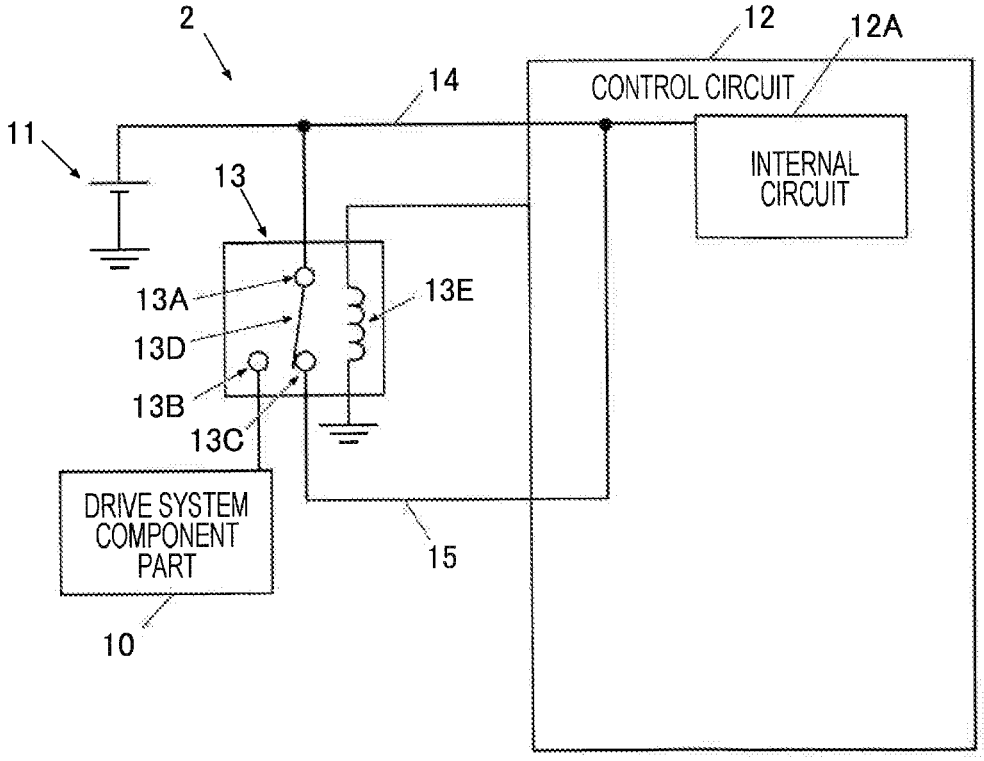
FIG. 4 is a diagram illustrating a configuration of an electromagnetic relay deicing system according to a second embodiment of the disclosure.

FIG. 4 illustrate a configuration of an electromagnetic relay deicing system 2 according to a second embodiment of the disclosure.

In this embodiment, too, an electromagnetic relay 13 is a three-contact relay that includes a common terminal 13A, a normally open terminal 13B, a normally closed terminal 13C, a movable piece 13D, and an exciting coil 13E. The exciting coil 13E of the electromagnetic relay 13 is connected to a control circuit 12. The control circuit 12 controls the excitation and the stop of excitation of the exciting coil 13E (i.e., the turning on and off of the electromagnetic relay 13).

Incidentally, when the electromagnetic relay 13 is off, the movable piece 13D connects the common terminal 13A and the normally closed terminal 13C as illustrated in FIG. 4.

In this embodiment, the aforementioned redundancy wire 15 of the control circuit 12 is connected to the normally closed terminal 13C of the electromagnetic relay 13.

Furthermore, the control circuit 12 activates the internal circuit 12A during the off-state of the electromagnetic relay 13 so that electricity is conducted between the common terminal 13A and the normally closed terminal 13C of the electromagnetic relay 13.

Then, current from the accessory battery 11 flows through the electromagnetic relay 13 and the redundancy wire 15, so that the movable piece 13D of the electromagnetic relay 13 and the like become heated according to their electric resistances. As a result, the normally closed terminal 13B adjacent to the movable piece 13D is heated to melt the ice on the surface of the normally open terminal 13B.

In this embodiment, the electromagnetic relay 13 is deiced in the foregoing manner.

After a predetermined time elapses following the starting of the electric vehicle, the control circuit 12 excites the exciting coil 13E of the electromagnetic relay 13 to turn on the electromagnetic relay 13, so that the movable piece 13D of the electromagnetic relay 13 moved from the previous coupling partner, that is, the normally closed terminal 13C, is certainly coupled to the normally open terminal 13B because the surface of the normally open terminal 13B has become rid of ice.

Therefore, electric power is certainly supplied from the accessory battery 11 to the drive system component part 10 via the electromagnetic relay 13, so that the drive system component part 10 activates.

As described above, in the electromagnetic relay deicing system 2 according to this embodiment, the control circuit 12 activates the internal circuit 12A to energize the electromagnetic relay 13 and therefore cause the movable piece 13D of the electromagnetic relay 13 and the like to produce heat during the off-state of the electromagnetic relay 13, so that ice on the surface of the normally open terminal 13B of the electromagnetic relay 13 is melted and thus the electromagnetic relay 13 is deiced.

Therefore, this embodiment deices the electromagnetic relay 13 during the off-state of the electromagnetic relay 13, and therefore hammering is not performed, unlike the foregoing related art. This makes it possible to deice the electromagnetic relay 13 without increasing the number of times that the electromagnetic relay 13 is turned on and off.

When the internal circuit 12A of the electromagnetic circuit 12 is activated, a voltage from the accessory battery 11 (e.g., 12 V) is applied across the electromagnetic relay 13. The current that flows through the electromagnetic relay 13 and the like is large because the electric resistances of the electromagnetic relay 13 and the redundancy wire 15 are small.

Therefore, the temperatures of the movable piece 13D and the like sharply increase and, therefore, the normally open terminal 13B adjacent to the movable piece 13D and the like is rapidly heated, melting ice on the surface of the normally open terminal 13B. Thus, the deicing of the electromagnetic relay 13 is very quickly completed.

Therefore, in this embodiment, the amount of time for which the control circuit 12 causes electric conduction through the electromagnetic relay 13 and the like by activating the internal circuit 12A (i.e., the aforementioned predetermined time) is set to a very short time.

Thus, in the electromagnetic relay deicing system 2 according to this embodiment, the current that flows through the electromagnetic relay 13 is large but continues only for a very short time, so that it becomes possible to precisely reduce the energy loss, that is, the amount of energy of the accessory battery 11 that is consumed in order to deice the electromagnetic relay 13.

Furthermore, the electromagnetic relay deicing system 2 according to this embodiment can be configured merely by replacing the two-contact relay 100 in the related-art system (see FIG. 3) with the three-contact relay 13 (see FIG. 4) and changing the coupling of the redundancy wire 15 of the control circuit 12 to the coupling to the normally closed terminal 13C of the electromagnetic relay 13.

Therefore, it becomes possible to precisely deice the electromagnetic relay 13 merely by making a simple alteration to a related-art control system without a need to newly provide a large-scale apparatus or circuit.

It is to be noted that since the electromagnetic relay deicing system 2 illustrated in FIG. 4 is not provided with the electric resistor 21 that is provided in the first embodiment (see FIG. 2), the electromagnetic relay deicing system 2 cannot control the amount of current that flows through the electromagnetic relay 13 when the control circuit 12 causes electricity to be conducted through the electromagnetic relay 13 by activating the internal circuit 12A during the off-state of the electromagnetic relay 13.

Therefore, although not illustrated in the drawings, the electromagnetic relay deicing system 2 can be configured to control the amount of current that flows through the electromagnetic relay 13, by providing an electric resistor on a portion of the redundancy wire 15 which is within the control circuit 12 or which extends between the control circuit 12 and the electromagnetic relay 13.

Furthermore, the first and second embodiments have been described above in conjunction with the case where the control circuit 12 carries out the deicing of the electromagnetic relay 13 during the predetermined time following the starting of the electric vehicle and, after elapse of the predetermined time, turns on the electromagnetic relay 13 without checking whether the deicing of the electromagnetic relay 13 is complete.

However, the electromagnetic relay deicing system can also be configured so as to check whether the electromagnetic relay 13 has been deiced, for example, by the control circuit 12 communicating with the drive system component part 10 to check whether the drive system component part 10 is operating after the electromagnetic relay 13 is turned on, or by measuring the voltage between the electromagnetic relay 13 and the drive system component part 10 to check whether the voltage of the accessory battery 11 (e.g., 12 V) is being applied between the electromagnetic relay 13 and the drive system component part 11.

Third Embodiment

Although the first and second embodiments have been described in conjunction with the case where the electromagnetic relay 13 provided on an intermediate portion of the circuit path that extends from the accessory battery 11, which is an electric power supplier, to the drive system component part 10, which is an electrical apparatus, the electromagnetic relay deicing system according to the disclosure can also be applied to other control systems.

Figure 5:
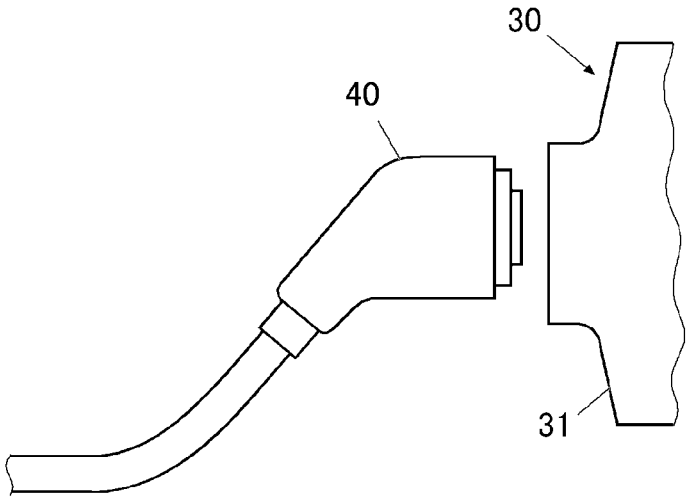
FIG. 5 is a diagram illustrating a charging gun being about to be attached to an inlet of an electric vehicle.

For example, a battery of an electric vehicle is charged as follows. As illustrated in FIG. 5, a charging gun 40 is attached to an inlet 31 of an electric vehicle 30 to supply electric power from a charging apparatus to the battery of the electric vehicle 30 via the charging gun 40 and the inlet 31, so that the battery is charged.

The inlet 31 of the electric vehicle 30 is provided with a built-in electric motor 32 (see FIG. 6, which will be described later). For example, by turning the motor 32 forward by a predetermined angle with the charging gun 40 attached to the inlet 31, the charging gun 40 is locked to the inlet 31. The charging gun 40 is unlocked by turning the motor 32 backward by a predetermined angle.

Figure 6:
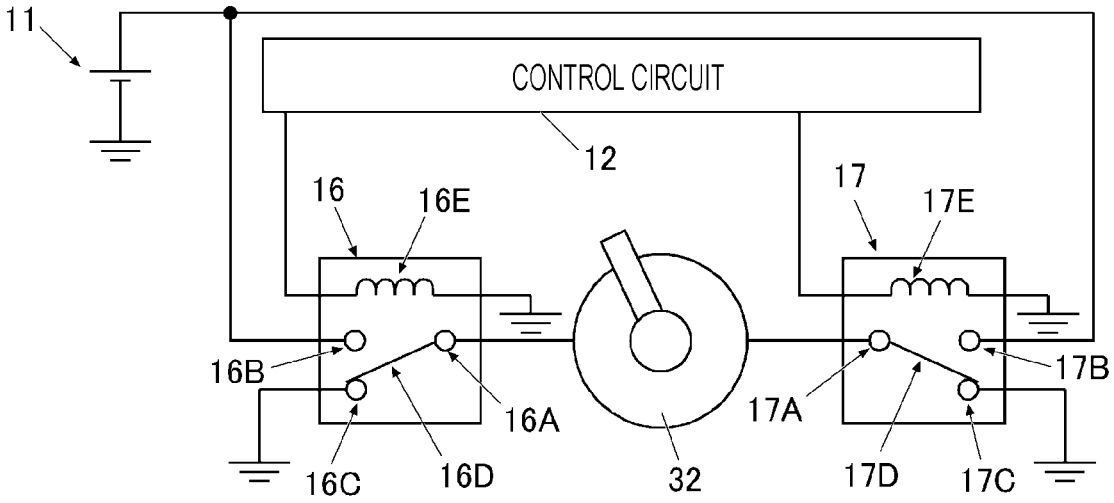
FIG. 6 is a diagram illustrating an example of a control system for controlling the locking and unlocking of the charging gun.

In this case, for example, as illustrated in FIG. 6, the forward and backward rotation of the motor 32 is controlled by using two electromagnetic relays, that is, an electromagnetic relay 16 for locking the charging gun 40 (hereinafter, referred to as the "locking relay 16") and an electromagnetic relay 17 for unlocking the charging gun 40 (hereinafter, referred to as the "unlocking relay 17").

In the following description, substantially the same members and the like as those in the first and second embodiments will be represented by the same reference characters as those used in the first embodiment and the like. Furthermore, description of the same members and the like as those in the first embodiment and the like may be omitted.

Concretely, in this embodiment, the locking relay 16 and the unlocking relay 17 both are three-contact relays that include common terminals 16A and 17A, normally open terminals 16*b* and 17B, normally closed terminals 16C and 17C, movable pieces 16D and 17D, and exciting coils 16E and 17E, respectively.

The common terminals 16A and 17A of the locking relay 16 and the unlocking relay 17 are individually connected to the motor 32. Note that the common terminals 16A and 17A of the locking relay 16 and the unlocking relay 17 are electroconductively connected via the motor 32.

Furthermore, the normally open terminals 16B and 17B of the locking relay 16 and the unlocking relay 17 are separately connected to an accessory battery 11, a main battery (not illustrated in the drawings), etc. and the normally closed terminals 16C and 17C are separately grounded.

The exciting coils 16E and 17E of the locking relay 16 and the unlocking relay 17 are connected to a control circuit 12. The control circuit 12 controls the excitation of the exiting coils 16E and 17E and the stop of the excitation (i.e., the turning on and off of the locking relay 16 and the unlocking relay 17). When the locking relay 16 and the unlocking relay 17 are off, the movable pieces 16D and 17D connect the common terminals 16A and 17A to the normally closed terminals 16C and 17C, respectively, as illustrated in FIG. 6.

Figure 7A:
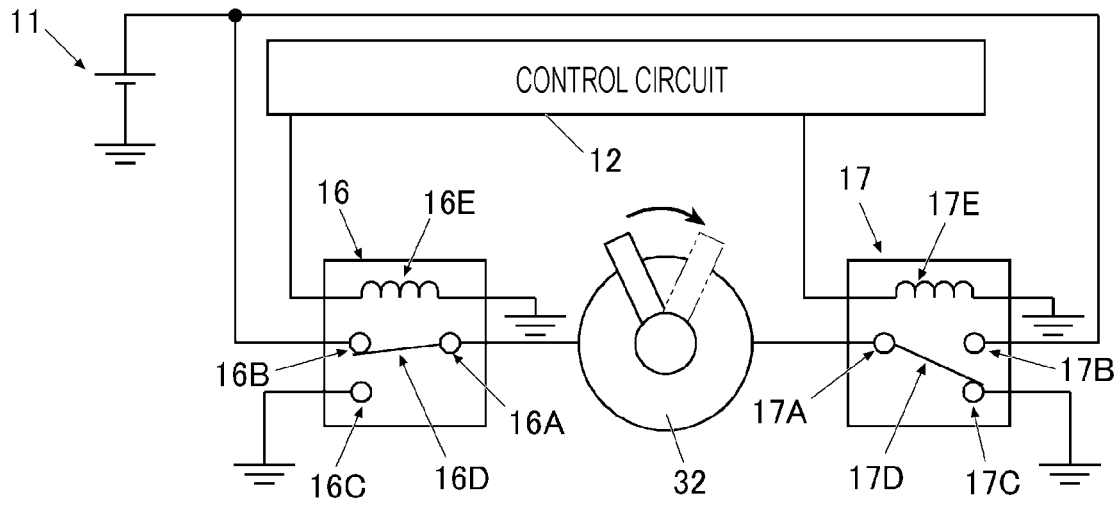
FIG. 7A is a diagram illustrating how the control system illustrated in FIG. 6 performs control to lock the charging gun.

Then, as, during the off-state of the locking relay 16 and the unlocking 17, the control circuit 12 turns on the locking relay 16 to switch the coupling partner of the movable piece 16D of the locking relay 16 to the normally open terminal 16B (see FIG. 7A), current flows from the accessory battery 11 to the motor 32 via the locking relay 16 and flows through the unlocking relay 17.

As a result, the motor 32 rotates forward by a predetermined angle (see an arrow near the motor 32 in FIG. 7A), locking the charging gun 40 that has been attached to the inlet 31. After the motor 32 rotates forward by the predetermined angle, the control circuit 12 turns off the locking relay 16. Therefore, the state in which the locking relay 16 and the unlocking relay 17 are both off is resumed.

Figure 7B:
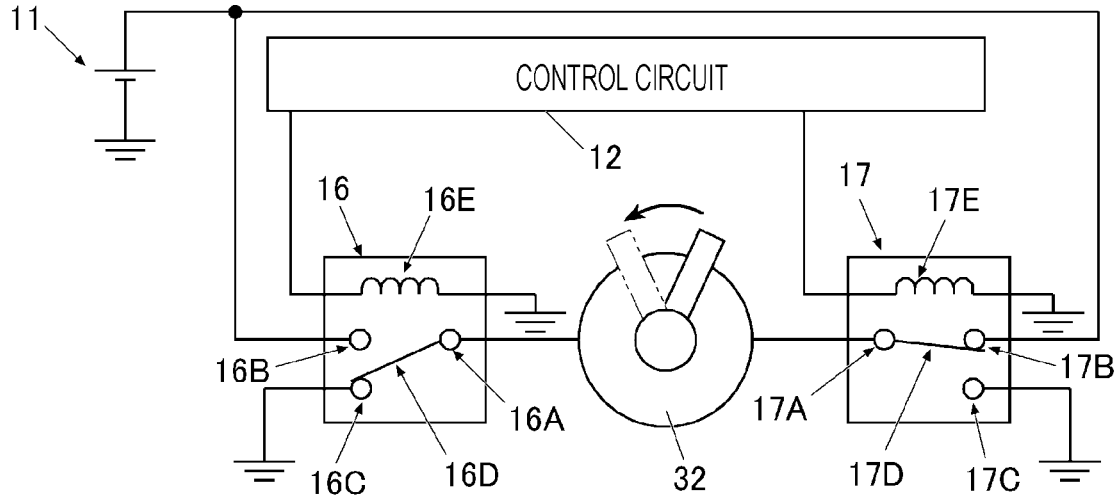
FIG. 7B is a diagram illustrating how the control system performs control to unlock the charging gun.

Furthermore, as, during the off-state of the locking relay 16 and the unlocking relay 17, the control circuit 12 turns on the unlocking relay 17 to switch the coupling partner of the movable piece 17D of the unlocking relay 17 to the normally open terminal 17B (see FIG. 7B), current flows from the accessory battery 11 to the motor 32 via the unlocking relay 17 and flows through the locking relay 16.

As a result, the motor 32 rotates backward by a predetermined angle (see an arrow near the motor 32 in FIG. 7B), undoing the locking of the charging gun 40. After the motor 32 rotates backward by the predetermined angle, the control circuit 12 turns off the unlocking relay 17. Therefore, the state in which the locking relay 16 and the unlocking relay 17 are both off is resumed.

That is, to lock the charging gun 40, the control circuit 12 causes current to flow from the locking relay 16 side to the unlocking relay 17 side via the motor 32. To unlock the charging gun 40, the control circuit 12 causes current to flow in the opposite direction, that is, from the unlocking relay 17 side to the locking relay 16 side via the motor 32.

Thus, in this embodiment, two electromagnetic relays (i.e., the locking relay 16 and the unlocking relay 17) are individually connected to a single electrical apparatus (i.e., the motor 32), and the two electromagnetic relays 16 and 17 are configured to supply electric power to the electrical apparatus 32 (more specifically, to cause currents to flow in opposite directions through the electrical apparatus 32) when turned on.

Next, an electromagnetic relay deicing system 3 that uses the foregoing configuration will be described.

For example, if the locking relay 16 is iced when the charging gun 40 is to be attached to the inlet 31 of the electric vehicle 30, current cannot flow from the locking relay 16 side to the motor 32 and therefore the charging gun 40 cannot be locked. As a result, the charging of the electric vehicle 30 cannot be carried out.

Furthermore, for example, if the unlocking relay 17 is iced when the charging of the electric vehicle 30 is completed after the charging gun 40 has been attached and locked to the inlet 31 of the electric vehicle 30 in order to carry out charging, the charging gun 40 cannot be released from the locked state despite an attempt to unlock the charging gun 40. Then, the charging gun 40 attached to the inlet 31 of the electric vehicle 30 cannot be released from the attached state, so that the electric vehicle 30 cannot be pulled off.

According to this embodiment, in such cases, where one of the electromagnetic relays (the deicing-object electromagnetic relay that is to be deiced) is off, the control circuit 12 deices that electromagnetic relay by turning on the second one of the electromagnetic relays to supply electric power from the second electromagnetic relay to the electrical apparatus (the motor 32 in this case) and therefore causing current to flow to the first electromagnetic relay via the electrical apparatus so as to heat the movable piece and the like.

A deicing process will be described below in conjunction with a case where deicing is carried out at the time of unlocking the charging gun 40 (i.e., deicing is carried out on the unlocking relay 17).

Figure 8:
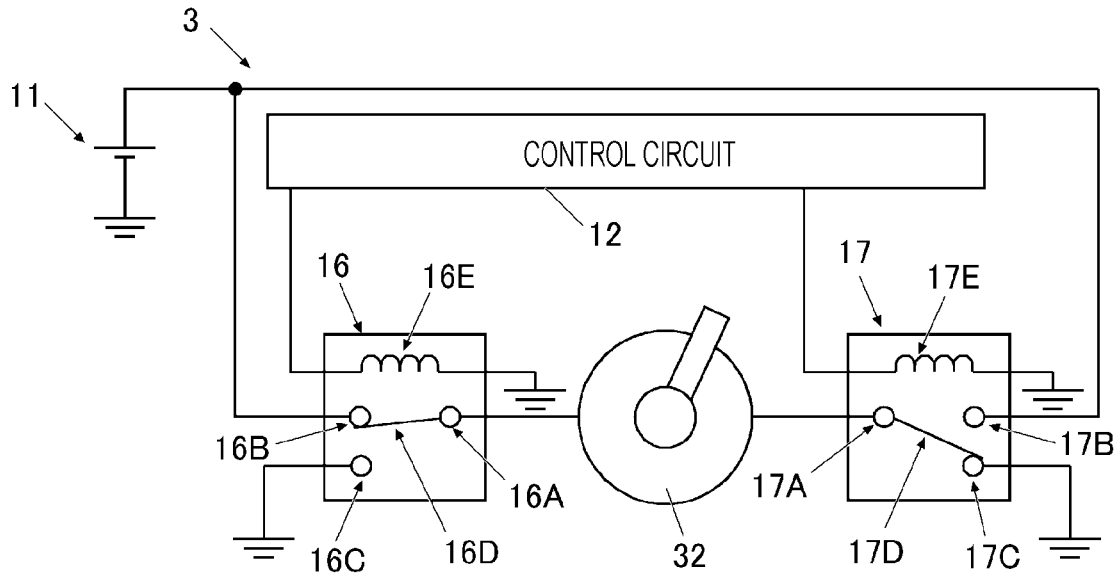
FIG. 8 is a diagram illustrating how an electromagnetic relay deicing system according to a third embodiment of the disclosure is configured and how the system performs control.

In this case, the motor 32 has rotated forward completely to a lock position as illustrated in FIG. 8. During this state, where the deicing-object electromagnetic relay, that is, the unlocking relay 17, is off (i.e., where the common terminal 17A and the normally closed terminal 17C of the unlocking relay 17 are connected by the movable piece 17D), the control circuit 12 turns on the locking relay 16, the other electromagnetic relay. Specifically, the control circuit 12 excites the exciting coil 16E of the locking relay 16 to switch the coupling partner of the movable piece 16D to the normally open terminal 16B.

Then, via the locking relay 16, electric power is supplied from the accessory battery 11 to the motor 32. Since the motor 32 has rotated forward completely, the motor 32 does not rotate further forward.

Flowing from the locking relay 16 to the motor 32, current flows from the motor 32 through the unlocking relay 17. In this manner, the movable piece 17D of the unlocking relay 17 is caused to conduct electricity between the common terminal 17A and the normally closed terminal 17C.

Therefore, the movable piece 17D of the unlocking relay 17 and the like produce heat according to their electric resistances, so that the normally open terminal 17B, which is adjacent to the movable piece 17D, is heated and therefore ice on the surface of the normally open terminal 17B melts.

The electromagnetic relay deicing system 3 according to this embodiment is configured to deice the unlocking relay 17 in the foregoing manner.

Although not illustrated in the drawings, deicing at the time of locking the charging gun 40 (i.e., deicing of the locking relay 16) can be carried out in a manner similar to the foregoing manner. That is, the locking relay 16 can be deiced by the control circuit 12 turning on the unlocking relay 17 (with the locking relay 16 in the off-sate) during the state in which the motor 32 has rotated backward completely to the unlock position.

In this case, too, since the motor 32 has rotated backward completely, the motor 32 does not rotate further backward.

As described above, the electromagnetic relay deicing system 3 according to this embodiment accomplishes the deicing operation of melting ice on the surface of the normally open terminal of a deicing-object electromagnetic relay (e.g., the unlocking relay 17) by causing another electromagnetic relay (e.g., the locking relay 16) to be in the on-state during the state in which the deicing-object electromagnetic relay is off, so that, without rotating the motor 32, the deicing-object electromagnetic relay in the off-state is caused to conduct electricity and therefore the movable piece of the deicing-object electromagnetic relay and the like produce heat.

Thus, in this embodiment, since the deicing-object electromagnetic relay is deiced during the off-state of the electromagnetic relay, there is no need to perform hammering, unlike the foregoing related-art technologies. Therefore, it becomes possible to deice an electromagnetic relay without increasing the number of times that the electromagnetic relay is turned on and off.

The motor 32 is usually configured so that its internal electric resistance is very small. Therefore, when a voltage from the accessory battery 11 (e.g., 12 V) is applied across the motor 32, large current flows through the motor 32, the deicing-object electromagnetic relay, etc.

Therefore, in the deicing-object electromagnetic relay, the temperatures of the movable piece and the like sharply increase and therefore the normally open terminal adjacent to the movable piece and the like is rapidly heated, so that the ice on the surface of the normally open terminal melts. Thus, the electromagnetic relay is deiced in a very short time.

Therefore, in this embodiment, the duration of the electric conduction through the deicing-object electromagnetic relay is set to a very short time.

Thus, in the electromagnetic relay deicing system 3 according to the embodiment, the current that flows through the deicing-object electromagnetic relay may be large but continues only for a very short time, so that it becomes possible to precisely reduce the energy loss of the accessory battery 11 that occurs for the deicing of the electromagnetic relay.

Furthermore, the electromagnetic relay deicing system 3 according to the embodiment uses an existing system (see FIG. 6 and the like) as it is, without adding any device, circuit, etc., but adopts a novel manner of control, so that it becomes possible to deice an electromagnetic relay without a need to newly provide a large-scale apparatus or circuit for the system.

This embodiment, similarly to the foregoing embodiments, has been described above in conjunction with the case where the control circuit 12 carries out the deicing of an electromagnetic relay automatically following the starting of the electric vehicle and, after the predetermined time elapses, the control circuit 12 turns on the electromagnetic relay without checking whether the deicing of the electromagnetic relay is complete.

However, it is also possible to adopt a configuration in which after turning on a deicing-object electromagnetic relay, the control circuit 12 checks whether the deicing-object electromagnetic relay has been deiced by, for example, checking whether the motor 32 has rotated successfully by a predetermined angle (forward or backward).

It should be apparent that the disclosure is not limited to the foregoing embodiments or the like and various modifications can be made as appropriate without departing from the gist of the disclosure.

The invention claimed is:

1. An electromagnetic relay deicing system comprising:

an electromagnetic relay comprising a common terminal, a normally open terminal, and a normally closed terminal, and the electromagnetic relay configured to supply electric power from an electric power supplier to an electrical apparatus when the common terminal and the normally open terminal are connected; and a control circuit configured to control an on-state and an off-state of the electromagnetic relay, wherein during the on-state of the electromagnetic relay, the common terminal and the normally open terminal are connected by a movable piece and during the off-state of the electromagnetic relay, the common terminal and the normally closed terminal are connected by the movable piece, and wherein the control circuit deices the electromagnetic relay by causing, during the off-state of the electromagnetic relay, electric conduction between the common terminal and the normally closed terminal connected by the movable piece so that ice on a surface of the normally open terminal melts.

2. The electromagnetic relay deicing system according to claim 1, wherein the electromagnetic relay further comprises an exciting coil configured to, when excited, switch a coupling partner of the movable piece from the normally closed terminal to the normally open terminal, and wherein the control circuit causes the electromagnetic relay to be in the on-state by exciting the exciting coil.

3. The electromagnetic relay deicing system according to claim 2, wherein the normally closed terminal of the electromagnetic relay is connected to an electric resistor via a switch, and wherein the control circuit causes electric conduction between the common terminal and the normally closed terminal of the electromagnetic relay so as to deice the electromagnetic relay by closing the switch during the off-state of the electromagnetic relay.

4. The electromagnetic relay deicing system according to claim 2, wherein the normally closed terminal of the electromagnetic relay is connected to a redundancy wire of the control circuit, wherein the control circuit comprises an internal circuit connected to the redundancy wire, and wherein the control circuit causes electric conduction between the common terminal and the normally closed terminal of the electromagnetic relay so as to deice the electromagnetic relay by activating the internal circuit during the off-state of the electromagnetic relay.

5. The electromagnetic relay deicing system according to claim 2, wherein two of the electromagnetic relay are individually connected to the electrical apparatus and the two electromagnetic relays are each configured to supply electric power to the electrical apparatus when in the on-state, and wherein the control circuit causes electric conduction between the common terminal and the normally closed terminal of a first electromagnetic relay of the electromagnetic relays so as to deice the first electromagnetic relay by turning on a second electromagnetic relay of the electromagnetic relays during the off-state of the first electromagnetic relay so as to supply electric power from the second electromagnetic relay to the electrical apparatus so that current flows to the first electromagnetic relay via the electrical apparatus.

6. The electromagnetic relay deicing system according to claim 1, wherein the normally closed terminal of the electromagnetic relay is connected to an electric resistor via a switch, and wherein the control circuit causes electric conduction between the common terminal and the normally closed terminal of the electromagnetic relay so as to deice the electromagnetic relay by closing the switch during the off-state of the electromagnetic relay.

7. The electromagnetic relay deicing system according to claim 1, wherein the normally closed terminal of the electromagnetic relay is connected to a redundancy wire of the control circuit, wherein the control circuit comprises an internal circuit connected to the redundancy wire, and wherein the control circuit causes electric conduction between the common terminal and the normally closed terminal of the electromagnetic relay so as to deice the electromagnetic relay by activating the internal circuit during the off-state of the electromagnetic relay.

8. The electromagnetic relay deicing system according to claim 1, wherein two of the electromagnetic relay are individually connected to the electrical apparatus and the two electromagnetic relays are each configured to supply electric power to the electrical apparatus when in the on-state, and wherein the control circuit causes electric conduction between the common terminal and the normally closed terminal of a first electromagnetic relay of the electromagnetic relays so as to deice the first electromagnetic relay by turning on a second electromagnetic relay of the electromagnetic relays during the off-state of the first electromagnetic relay so as to supply electric power from the second electromagnetic relay to the electrical apparatus so that current flows to the first electromagnetic relay via the electrical apparatus.

* * * * *